US005453027A

United States Patent [19]

Buell et al.

[11] Patent Number: 5,453,027

[45] Date of Patent: Sep. 26, 1995

[54] WASHER FOR ESTABLISHING ELECTRICAL CONTINUITY BETWEEN CONDUCTIVE COMPONENTS HAVING NON-CONDUCTIVE COATINGS

[75] Inventors: Scott D. Buell, Andover; Roman M. Lucyk, Coon Rapids; Todd J. Mickley, Andover, all of Minn.

[73] Assignee: Federal-Hoffman, Inc., Anoka, Minn.

[21] Appl. No.: 378,863

[22] Filed: Jan. 23, 1995

Related U.S. Application Data

[63] Continuation of Ser. No. 164,194, Dec. 8, 1993, abandoned.

[51] Int. Cl.[6] ..... H01R 11/12

[52] U.S. Cl. ..... 439/433; 439/426; 439/434; 439/883

[58] Field of Search ..... 439/387, 426, 439/433, 434, 883, 864, 533, 160, 161, 162, 163, 164, 165

[56] References Cited

U.S. PATENT DOCUMENTS

| | | | |
|---|---|---|---|
| 1,946,713 | 2/1934 | Rowley | 439/868 OR |
| 1,994,251 | 3/1935 | Mueller | 439/434 X |
| 2,297,261 | 9/1942 | Thode | 411/957 X |
| 2,518,399 | 8/1950 | Thompson | 411/957 X |
| 3,340,494 | 9/1967 | Gutshall | 439/434 OR |
| 3,761,867 | 9/1973 | Churla | 439/883 X |
| 3,914,001 | 10/1975 | Nelson et al. | 439/433 X |
| 4,023,882 | 5/1977 | Pettersson | 439/426 ER |
| 4,589,715 | 5/1986 | Weisenburger | 439/426 X |
| 4,775,337 | 10/1988 | Van Wagener et al. | 439/883 OR |
| 5,207,535 | 5/1993 | Saab | 411/533 X |

*Primary Examiner*—Larry I. Schwartz
*Assistant Examiner*—Daniel Wittels
*Attorney, Agent, or Firm*—Merchant, Gould, Smith, Edell, Welter & Schmidt

[57] ABSTRACT

The invention comprises a washer for establishing electrical continuity between two conductive members each having a non-conductive coating and which are secured together by threaded fasteners such as screws. The washer has projections that pierce the non-conductive coatings of the two conductive components as the threaded fasteners are tightened thereby establishing electrical continuity through the washer.

1 Claim, 3 Drawing Sheets

WASHER FOR ESTABLISHING ELECTRICAL CONTINUITY BETWEEN CONDUCTIVE COMPONENTS HAVING NON-CONDUCTIVE COATINGS

This is a CONTINUATION of application Ser. No. 08/164,194, filed Dec. 8, 1993, now abandoned.

BACKGROUND OF THE INVENTION

The present invention relates broadly to a washer adapted to establish electrical continuity between conductive components fastened together each of which has a non-conductive coating. The present invention has particular applicability to the field of electrical housings or enclosures. Typically such enclosures are metal boxes in which electrical components and/or electrical wiring is enclosed. The enclosure has a removable access cover. While both the enclosure housing and access cover are conductive metal the surfaces of each are covered with a protective non-conductive coating such as paint. Frequently it is desirable to electrically ground the enclosure including the access cover. To establish electrical continuity between the enclosure housing and the access cover in the prior art the non-conductive coating would be removed from the surfaces of the housing and access cover around cooperating bore holes in the two components which received fasteners such as screws for securing the components together. Another prior art method involved leaving the surfaces of the enclosure and access cover around the bore holes uncoated during the manufacturing process. Each of these prior art methods increased manufacturing and assembly costs.

The present invention provides a means to establish electrical continuity between the two coated components without the need for these additional manufacturing and assembly steps.

SUMMARY OF THE INVENTION

The present invention is a washer having a generally planar ring member with an opening in which is received a threaded fastener such as a screw which secures two conductive components to each other. The washer has a plurality of projecting members disposed about the periphery of the ring member. The ring member has first and second planar surfaces lying in parallel planes generally perpendicular to the central axis of the washer. At least one of the projecting members extends above the first planar surface of the ring member and at least one projecting member extends above the second planar surface of the ring member. The projecting members are adapted to penetrate or pierce non-conductive coatings on the mating conductive components to establish electrical continuity therebetween. As the threaded fasteners are tightened the projecting members pierce the coated surfaces of the components being secured together.

In the preferred embodiment of the present invention the ring member of the washer has a plurality of teeth disposed about its inner surface to engage the threads of the fastener. This serves to capture the washer on the fastener. The threaded fastener will then remain captured in the bore hole of the component receiving the fastener. The two components can thus be separated without the fasteners becoming loose and possibly being misplaced or lost.

In many applications of the present invention a sealing gasket is provided at the mating surfaces of the two electrical components. The gasket is typically a compressible material such as rubber. The effectiveness of the seal can be compromised if the gasket is overcompressed when the fasteners are tightened to secure the two components together. A further advantage of the present invention is that the projecting members on the washer function as a compression stop. In other words the projecting members limit the extent to which the threaded fastener can be tightened leaving a predetermined minimum spacing for the sealing gasket. These and other advantages of the present invention will become apparent with reference to the accompanying drawings, detailed description of the preferred embodiment and claims.

DETAILED DESCRIPTION OF THE PREFERRED EMBODIMENT

Figure 2:
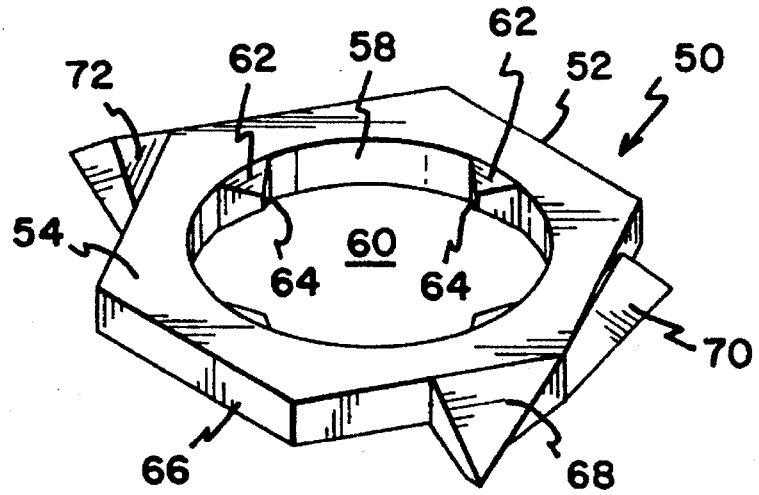
FIG. 2 is a view in perspective of the washer of the present invention.
Figure 1:
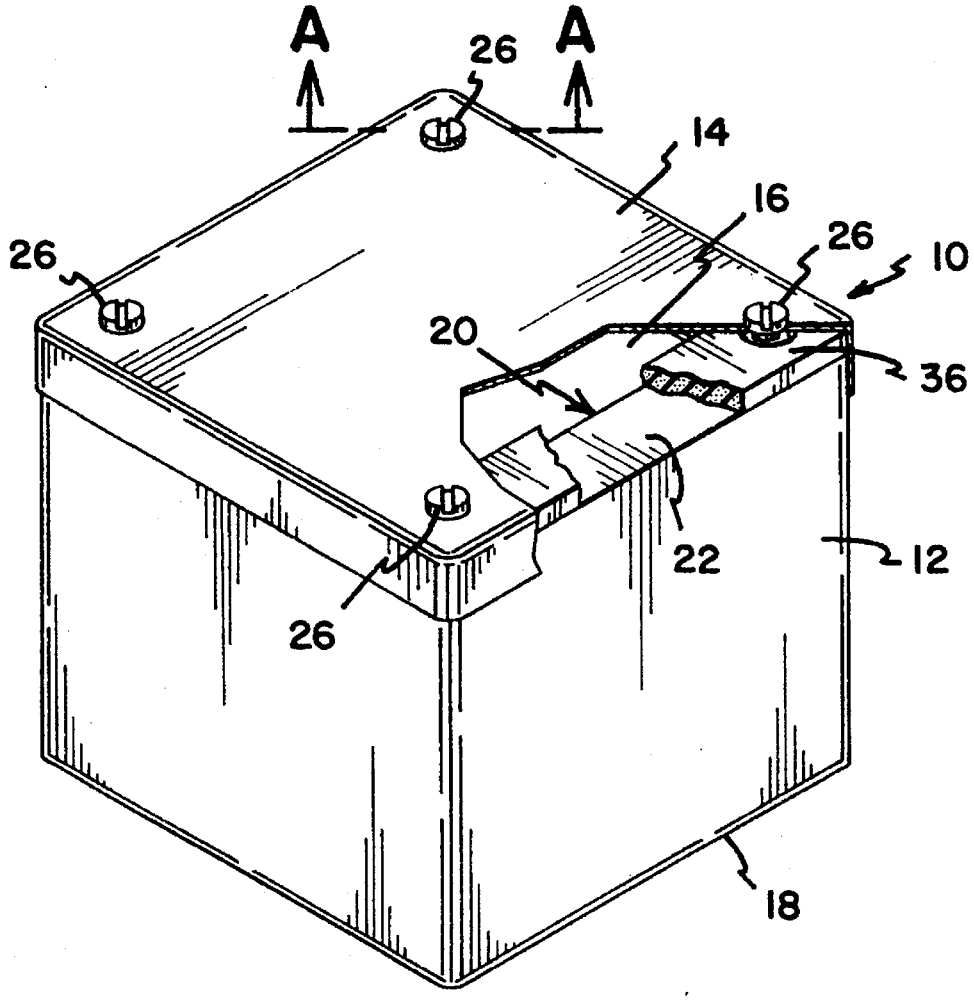
FIG. 1 is a view in perspective with a portion cut away illustrating the use of the present invention.
Figure 3:
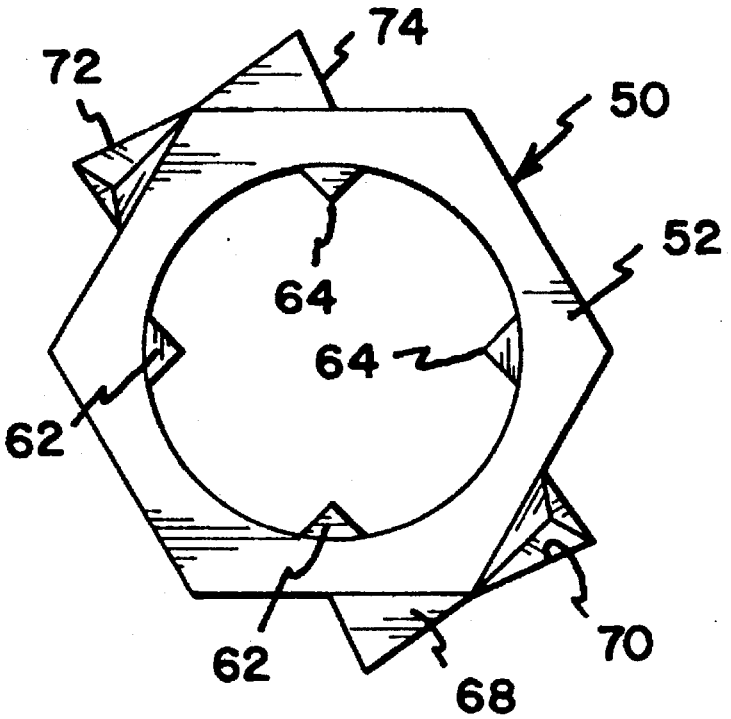
FIG. 3 is a plan view of the washer of the present invention.
Figure 5:
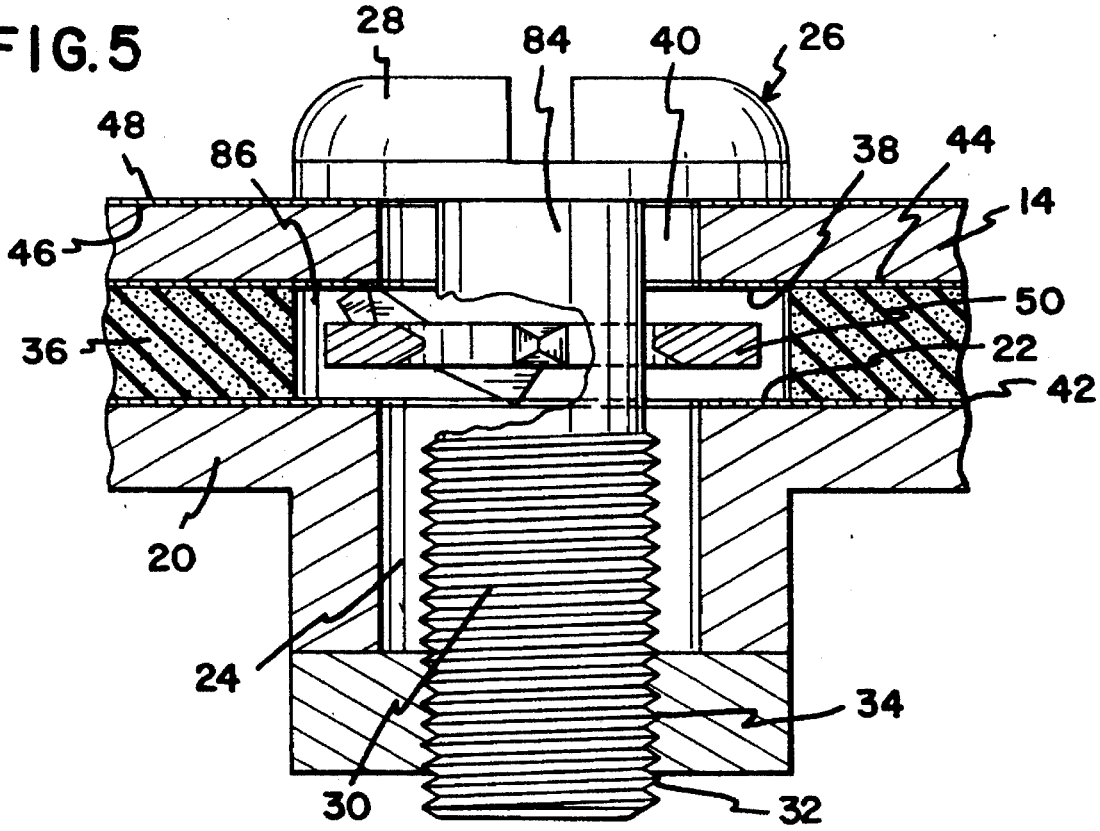
FIG. 5 is a view in section taken along the line A—A of FIG. 1 with a portion cut away.

FIG. 1 illustrates the use of the washer of the present invention in an enclosure 10. Enclosure 10 is of the type used to house electrical components. Enclosure 10 includes a housing 12 and a cover 14. Housing 12 has an open end at 16 and a closed end at 18. Extending about open end 16 is a rim member 20 having a generally planar surface 22. Rim member 20 is provided with a plurality of threaded bores, one of which is shown in FIG. 5 at 24. The threaded bores 24 are adapted to receive a threaded fastener such as a screw 26. As shown in more detail in FIG. 5 screw 26 has a head member 28 and a body 30 with external threads 32 adapted to mate with threads 34 of bore 24.

As shown in FIGS. 1 and 5 a gasket 36 is disposed between planar surface 22 of rim member 20 and an inner surface 38 of cover 14. Gasket 36 is formed of a compressible material, such as rubber or foam, and provides a seal between housing 12 and cover 14. Cover 14 is provided with a plurality of bore holes, one of which is illustrated at 40 in FIG. 5. Bore holes 40 receive screw 26.

Cover 14 and housing 12 are formed of an electrically conductive material, typically a metal. As shown in FIG. 5 planar surface 22 of rim member 20 has a non-conductive coating 42. Cover 14 also has a non-conductive coating 44 on inner surface 38. Cover 14 has an outer surface 46. A non-conductive coating 48 is also provided on outer surface 46.

In many applications electrical continuity must be established between cover 14 and housing 12. When enclosure 10 contains electrical components, for example, housing 12 is typically grounded and therefore it is important to also ground cover 14. The present invention includes a washer 50 which establishes the electrical continuity between one conductive component, housing 12 and the other conductive component, cover 14. Washer 50 is formed of an electrically conductive material such as stainless steel and has a ring member 52 that is essentially hexagonal in shape. Ring member 52 has a first planar surface 54 and a second planar surface 56. Surfaces 54 and 56 are disposed in parallel planes essentially perpendicular to a central axis of ring member 52 indicated by the designation X—X. Ring member 52 has an inner surface 58 which defines an opening 60 for receiving screw 26. Disposed about the circumference of inner surface 58 are a plurality of inwardly projecting teeth 62. Each of teeth 62 has an inwardly projecting apex as shown at 64.

Figure 4:
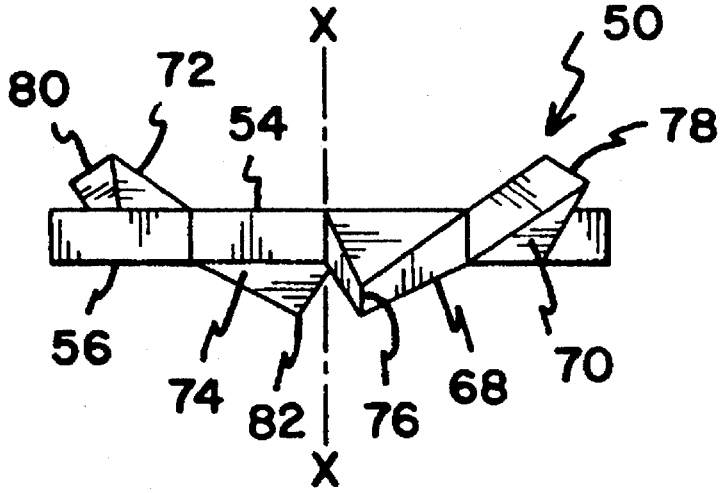
FIG. 4 is a view in elevation of the washer of the present invention.

Ring member 52 has an outer surface 66 which in the embodiment illustrated comprises six faces. Disposed about ring member 52 on outer surface 66 are a plurality of projecting members 68, 70, 72 and 74. In the illustrated preferred embodiment a pair of projecting members 68 and 70 are diametrically positioned on ring member 52 with respect to a pair of projecting members 72 and 74. Each of projecting members 68–74 are formed to have a sharpened edge as shown in FIG. 4 at 76, 78, 80 and 82, respectively. Projecting members 70 and 72 extend above first planar surface 54. Stated differently, projecting members 70 and 72 intersect the plane of first planar surface 54. Projecting members 68 and 74 extend above second planar surface 56. Also stated differently, projecting members 68 and 74 intersect the plane of second planar surface 56.

As shown in FIG. 5 washer 50 is inserted over threaded body 30 of screw 26. Body 30 has a smooth or non-threaded portion at 84. While washer 50 will fit loosely about smooth portion 84, teeth 62 frictionally engage the threads of body 30 thereby capturing washer 50 on screw 26. Gasket 36 is provided with an opening 86 accommodating washer 50. To secure cover 14 to housing 12 screw 26 with its captured washer 50 is inserted into threaded bore 24. Bore hole 40, bore 24 and washer 50 are sized so that when screw 26 is inserted in threaded bore 24 projecting members 68, 70, 72 and 74 engage planar surfaces 22 and 38. In other words projecting members 68, 70, 72 and 74 must extend radially from central axis X—X beyond the circumference of bore hole 40 and threaded bore 24. As screw 26 is tightened to secure cover 14 to housing 12, sharpened edges 76 and 82 scrape coating 42 from surface 22 while sharpened edges 78 and 80 similarly scrape coating 44 from inner surface 38. Washer 50 thus establishes electrical continuity between cover 14 and rim member 20 of housing 12. Projecting members 68–74 also establish a spacing between cover 14 and rim member 20. This limits the extent to which screw 26 may be tightened and thus the extent to which gasket 36 is compressed. Washer 50 thus in addition to establishing electrical continuity also serves as a compression stop to preserve the integrity of the seal provided by gasket 36.

If it becomes necessary to remove cover 14 from housing 12 for maintenance or service of the electrical components within enclosure 10, screws 26 are loosened and withdrawn from threaded bore 24. Washer 50 remains captured between threads 32 on body 30 and inner surface 38 of cover 14. This serves to capture screw 26 within bore hole 40. Thus neither screw 26 or washer 50 can be lost when cover 14 is removed.

It can be seen that the present invention is a washer that quickly and easily establishes electrical continuity between two mating electrically conductive components having non-conductive coatings. The washer is also designed to capture the fastening means to one of the components to prevent loss of the fasteners. The washer is also designed to limit the compression of a sealing gasket provided between the two joined components.

What is claimed is:

1. In an electrical housing having first and second housing members secured together by threaded fasteners received within corresponding apertures in said housing members, said first and second housing members formed of electrically conductive material and having a non-conductive protective coating and a sealing gasket disposed between the first and second housing members, the improvement comprising:

a washer formed of conductive material and having a substantially planar ring member with an inner surface defining an opening adapted to receive a threaded fastener, a central axis, and first and second surfaces lying in parallel planes substantially perpendicular to said central axis, said ring member having a first projection extending from said ring member above said first surface to engage a coated surface of the first housing member and a second projection extending from said ring member above said second surface to engage a coated surface of the second housing member, said first and second projections adapted to penetrate the non-conductive coatings to establish electrical continuity between said first and second housing members upon tightening of the threaded fastener to secure the first and second housing members together and whereby said first and second projections form a compression stop preventing over-tightening the threaded fastener; and said ring member having a plurality of teeth projecting into said opening to engage the threaded fastener thereby retaining said washer on the fastener.

* * * * *